US008034138B2

(12) United States Patent
Okada et al.

(10) Patent No.: US 8,034,138 B2
(45) Date of Patent: Oct. 11, 2011

(54) INDOOR UNIT OF AIR CONDITIONER

(75) Inventors: Morimichi Okada, Osaka (JP); Yoshiteru Nouchi, Osaka (JP); Tetsuya Morizane, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 103 days.

(21) Appl. No.: 12/523,017

(22) PCT Filed: Feb. 7, 2008

(86) PCT No.: PCT/JP2008/000178

§ 371 (c)(1),
(2), (4) Date: Jul. 13, 2009

(87) PCT Pub. No.: WO2008/096546

PCT Pub. Date: Aug. 14, 2008

(65) Prior Publication Data

US 2010/0107671 A1 May 6, 2010

(30) Foreign Application Priority Data

Feb. 9, 2007 (JP) ..... 2007-030814

(51) Int. Cl.
*B01D 46/00* (2006.01)

(52) U.S. Cl. ..... 55/289; 55/429; 55/430; 55/433; 55/466; 55/471

(58) Field of Classification Search ..... 96/296; 55/289, 429, 430, 433, 466, 471
See application file for complete search history.

(56) References Cited

U.S. PATENT DOCUMENTS 6,729,154 B2 * 5/2004 Takashima et al. ..... 62/317

FOREIGN PATENT DOCUMENTS

| | | | |
|---|---|---|---|
| JP | 63-104913 | U | 7/1988 |
| JP | 11-118183 | A | 4/1999 |
| JP | 2004-84998 | A | 3/2004 |
| JP | 3101034 | U | 6/2004 |
| JP | 2006-71121 | A | 3/2006 |

* cited by examiner

*Primary Examiner* — Duane Smith
*Assistant Examiner* — Tiffany Palmer
(74) *Attorney, Agent, or Firm* — Birch, Stewart, Kolasch & Birch, LLP

(57) ABSTRACT

An indoor unit of an air conditioner includes a filter member for trapping dust; a dust removing mechanism for removing the dust from the filter member; and a dust container for containing the dust removed from the filter member. The indoor unit further includes a container lifting/lowering mechanism for lifting/lowering the dust container relative to a casing; and a drive unit capable of alternatively performing removal operation by engaging with a dust removing mechanism to drive the dust removing mechanism, and lifting/lowering operation by engaging with a container lifting/lowering mechanism to drive the container lifting/lowering mechanism.

10 Claims, 6 Drawing Sheets

(A)

(B)

INDOOR UNIT OF AIR CONDITIONER

TECHNICAL FIELD

The present invention relates to an indoor unit of an air conditioner installed on a ceiling.

BACKGROUND ART

An indoor unit of an air conditioner installed on a ceiling has conventionally been known. In the field of the indoor unit of this type, an indoor unit having the function of removing dust trapped on a filter member has been known. Patent Document 1 discloses an indoor unit of this type.

Specifically, the indoor unit of Patent Document 1 includes, as a structure for removing dust on an air filter, a drive unit, a rotating brush, a collecting case, and a suction device. The air filter is in the shape of a disc, and traps dust contained in the air flowing into the unit through a suction grille. The air filter is provided with teeth formed on the periphery of a frame thereof. The drive unit includes a gear engaged with the teeth of the frame of the air filter. The rotating brush is configured to remove the dust from the air filter, and is in contact with the air filter at the tip thereof. The collecting case accommodates the rotating brush therein, and collects the dust removed by the rotating brush. The suction device is configured to suck and collect the dust fell in the collecting case.

In this indoor unit, the air filter rotates when the drive unit is operated, and the dust adhered to the air filter is removed by the rotating brush. The dust removed from the air filter falls in the collecting case, and the dust in the collecting case is sucked and collected by the suction device.

In the conventional indoor unit of the air conditioner, it has been known that the filter member is lifted/lowered relative to a casing together with a suction grille member provided on a bottom surface of the casing for easy cleaning of the filter member. The indoor unit of this type is disclosed by, for example, Patent Document 2.

Patent Document 1: Published Japanese Patent Application No. 2006-71121

Patent Document 2: Published Japanese Patent Application No. 2004-84998

DISCLOSURE OF THE INVENTION

Problem that the Invention is to Solve

The conventional indoor unit of the air conditioner which is installed in the ceiling space and has the function of removing the dust on the filter member involves work at high elevations in removing the dust accumulated in a dust container. Therefore, heavy labor has been required to remove the dust from the dust container.

In this point of view, the present invention was developed. The present invention is directed to the indoor unit of the air conditioner having the function of removing the dust trapped on the filter member from the filter member, and aims to provide a simple structure which allows for the lifting/lowering of the dust container relative to the casing.

Means of Solving the Problem

A first aspect of the invention is directed to an indoor unit of an air conditioner installed on a ceiling including: a casing (34) provided with an inlet (22) and an outlet (23), the indoor unit controlling temperature of air sucked therein through the inlet (22), and blowing the air into a room through the outlet (23); a filter member (41) for trapping dust contained in the air sucked through the inlet (22); a dust removing mechanism (42) for removing the dust trapped on the filter member (41) from the filter member (41); a dust container (43) for containing the dust removed from the filter member (41) by the dust removing mechanism (42); a container lifting/lowering mechanism (44) for lifting/lowering the dust container (43) relative to the casing (34); and a drive means (57) having a single drive motor (61), and being capable of alternatively performing removal operation of removing the dust from the filter member (41) by driving the dust removing mechanism (42) by the drive motor (61), and lifting/lowering operation of lifting/lowering the dust container (43) by driving the container lifting/lowering mechanism (44) by the drive motor (61).

According to a second aspect of the invention related to the first aspect of the invention, the dust removing mechanism (42) includes a brush member (50) which is in contact with the filter member (41), and a filter holding mechanism (51) for holding the filter member (41) in a movable manner, and the drive means (57) engages with the filter holding mechanism (51) in the removal operation to drive the filter holding mechanism (51), so as to move the filter member (41)

Advantages

According to the first aspect of the invention, the dust contained in the air sucked through the inlet (22) is trapped on the filter member (41). Then, when the drive means (57) performs the removal operation by driving the dust removing mechanism (42) by the drive motor (61), the dust trapped on the filter member (41) is removed from the filter member (41), and the removed dust accumulates in the dust container (43). As the amount of the dust in the dust container (43) increases, removal of the dust in the dust container (43) becomes necessary. According to the first aspect of the invention, the drive means (57) performs lifting/lowering operation by allowing the drive motor (61) to drive the container lifting/lowering mechanism (44), so as to remove the dust in the dust container (43). In the lifting/lowering operation, the dust container (43) is lowered from the casing (34) by the drive motor (61). After the dust in the dust container (43) is removed, the dust container (43) is lifted toward the casing (34) by the drive motor (61). The drive motor (61) is used for both the driving of the dust removing mechanism (42) and the lifting/lowering of the dust container (43).

According to the second aspect of the invention, the dust removing mechanism (42) includes the brush member (50) and the filter holding mechanism (51). The filter member (41) is held by the filter holding mechanism (51) in a movable manner. When the drive means (57) drives the filter holding mechanism (51), the filter member (41) moves. As the filter member (41) moves, the dust adhered to the filter member (41) is removed by the brush member (50).

Effect of the Invention

According to the present invention, the dust container (43) is lifted/lowered by driving the container lifting/lowering mechanism (44) by the drive motor (61). This structure does not involve the work at high elevations in removing the dust accumulated in the dust container (43). Therefore, the work of removing the dust from the dust container (43) is facilitated.

Further, according to the present invention, the drive motor (61) is used for both the driving of the dust removing mechanism (42) and the lifting/lowering of the dust container (43).

Specifically, there is no need of providing a motor for driving the dust removing mechanism (42) and a motor for lifting/lowering the dust container (43) separately. This provides a simple structure that allows for the lifting/lowering of the dust container (43) relative to the casing (34).

EXPLANATION OF REFERENCE NUMERALS

Figure 1:
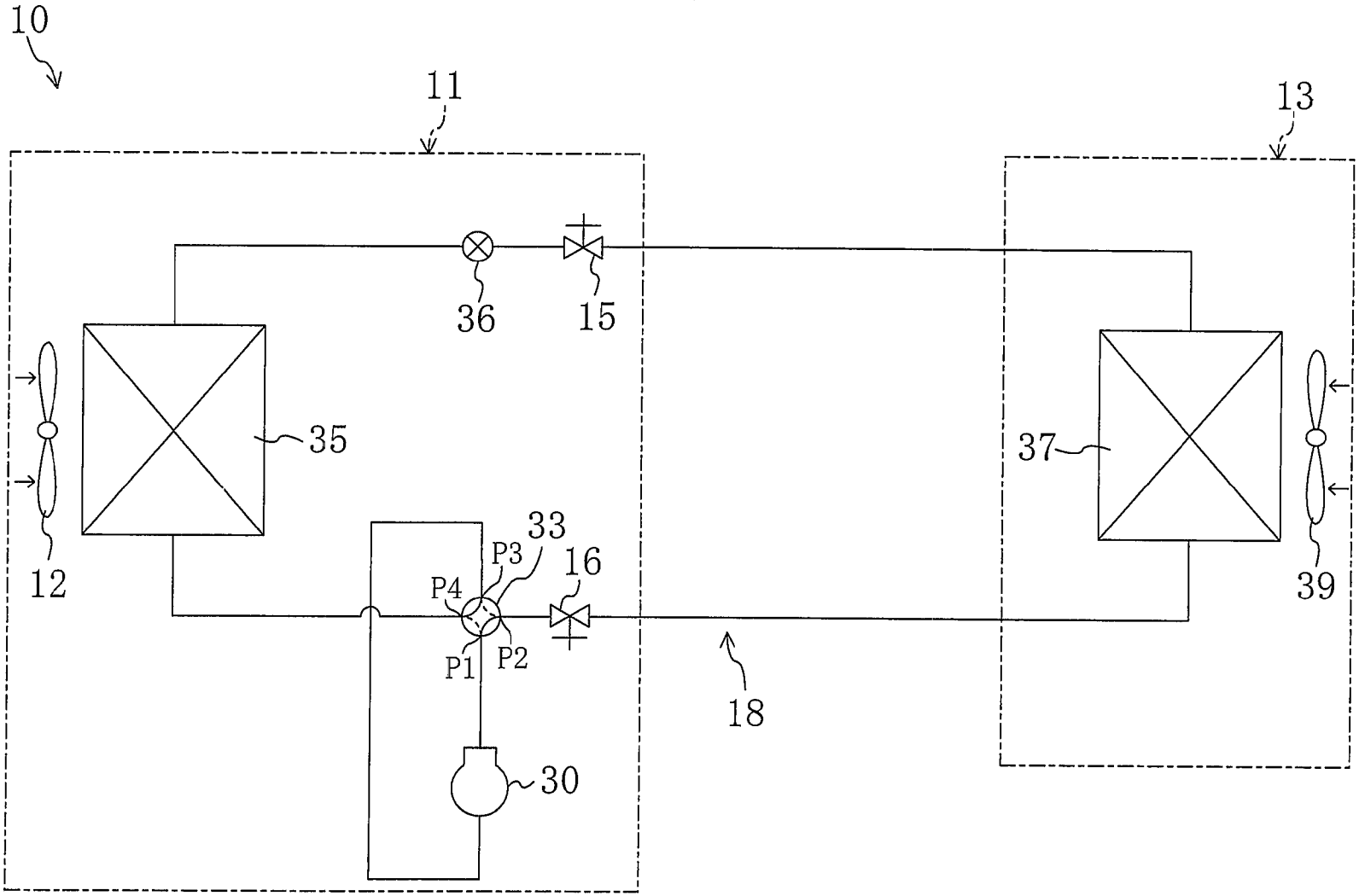
FIG. 1 is a schematic block diagram illustrating a refrigerant circuit of an air conditioner according to an embodiment of the present invention.

10 Air conditioner
13 Indoor unit
22 Inlet
23 Outlet
34 Casing
41 Suction filter (filter member)
42 Dust removing mechanism
43 Dust container
44 Container lifting/lowering mechanism
50 Rotating brush (brush member)
51 Filter holding mechanism
57 Drive mechanism (drive means)
61 Drive motor

BEST MODE FOR CARRYING OUT THE INVENTION

Hereinafter, an embodiment of the present invention will be described in detail with reference to the drawings.

The present embodiment is directed to an air conditioner (10) including an indoor unit (13) of the present invention. In this air conditioner (10), the indoor unit (13) is installed on a ceiling of a room. Hereinafter, the air conditioner (10) of the present embodiment will be described first, and then the indoor unit (13) of the present invention will be described.

The air conditioner (10) of the present embodiment includes, as shown in FIG. 1, an outdoor unit (11) and an indoor unit (13). The outdoor unit (11) includes a compressor (30), an outdoor heat exchanger (35), an expansion valve (36), a four-way switching valve (33) and an outdoor fan (12). The indoor unit (13) includes an indoor heat exchanger (37) and an indoor fan (39).

In the outdoor unit (11), a discharge side of the compressor (30) is connected to a first port (P1) of the four-way switching valve (33). A suction side of the compressor (30) is connected to a third port (P3) of the four-way switching valve (33).

The outdoor heat exchanger (35) is configured as a cross-fin type fin-and-tube heat exchanger. One end of the outdoor heat exchanger (35) is connected to a fourth port (P4) of the four-way switching valve (33). The other end of the outdoor heat exchanger (35) is connected to a liquid stop valve (15).

The outdoor fan (12) is arranged near the outdoor heat exchanger (35). In the outdoor heat exchanger (35), outdoor air sent by the outdoor fan (12) and a circulating refrigerant exchange heat. An expansion valve (36) capable of changing the degree of opening is provided between the outdoor heat exchanger (35) and the liquid stop valve (15). A second port (P2) of the four-way switching valve (33) is connected to a gas stop valve (16).

The four-way switching valve (33) is configured to be able to switch between a first state where the first port (P1) and the second port (P2) communicate with each other, and the third port (P3) and the fourth port (P4) communicate with each other (a state indicated by a solid line in FIG. 1), and a second state where the first port (P1) and the fourth port (P4) communicate with each other, and the second port (P2) and the third port (P3) communicate with each other (a state indicated by a broken line in FIG. 1).

In this air conditioner (10), when the compressor (30) is driven, and the four-way switching valve (33) is set to the first state, heating operation is performed. In the heating operation, a vapor compression refrigeration cycle is performed in which the outdoor heat exchanger (35) and the indoor heat exchanger (37) in the refrigerant circuit (18) function as an evaporator and a condenser, respectively. On the other hand, when the compressor (30) is driven, and the four-way switching valve (33) is set to the second state, cooling operation is performed. In the cooling operation, a vapor compression refrigeration cycle is performed in which the outdoor heat exchanger (35) and the indoor heat exchanger (37) in the refrigerant circuit (18) function as a condenser and an evaporator, respectively.

[Structure of Indoor Unit]

Figure 2:
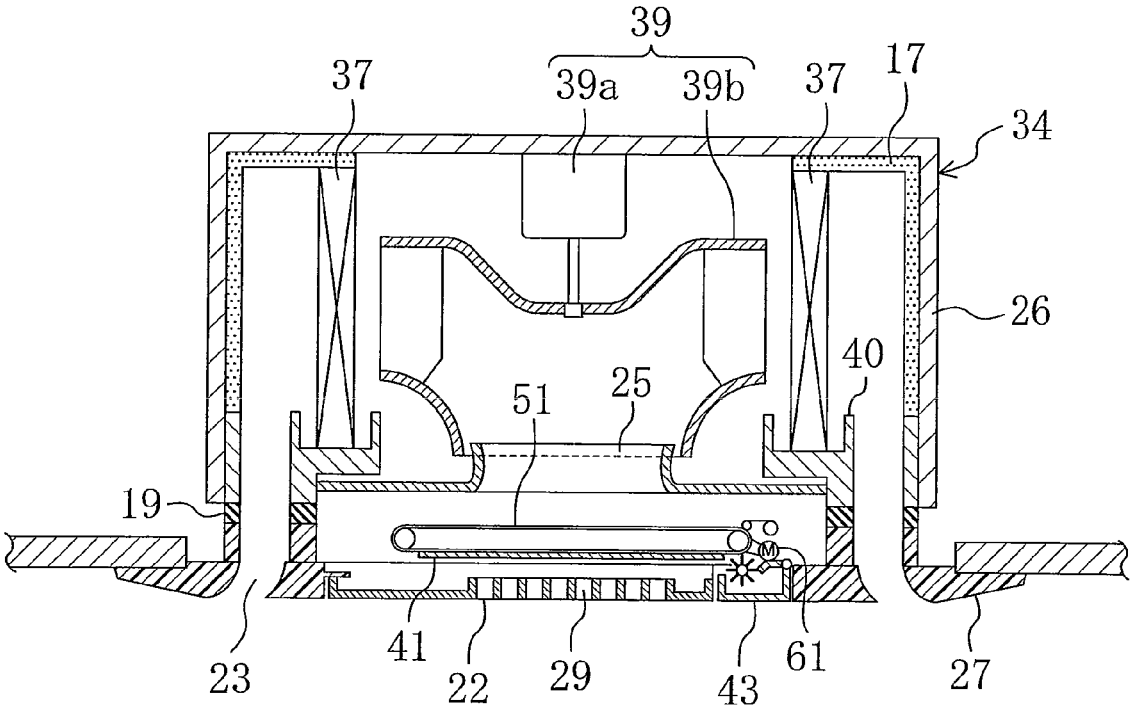
FIG. 2 is a cross-sectional view illustrating an indoor unit according to the embodiment of the present invention.

As shown in FIG. 2, the indoor unit (13) of the present invention includes a casing (34) including a casing body (26) and a decorative panel (27). In the casing (34), are placed the indoor heat exchanger (37), the indoor fan (39), a drain pan (40), a suction filter (41) as a filter member, a dust removing mechanism (42), a dust container (43), a container lifting/lowering mechanism (44), and a drive mechanism (57) as a drive means.

The casing body (26) is in the shape of a substantially rectangular parallelepiped box having an open bottom. A heat insulator (17) is laminated on an inner surface of the casing body (26). The casing body (26) is arranged so that its bottom is inserted in an opening in a ceiling board.

The decorative panel (27) is in the shape of a rectangular plate. When viewed in plan, the decorative panel (27) is slightly larger than the casing body (26). The decorative panel (27) is attached to the casing body (26) to cover the bottom of the casing body (26) with a sealant (19) sandwiched therebetween. The decorative panel (27) attached to the casing body (26) is exposed in the room.

Figure 3:
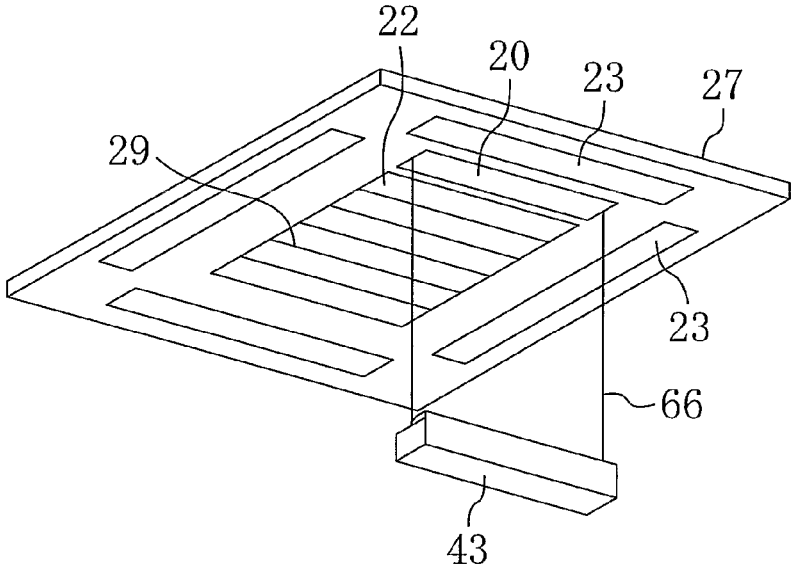
FIG. 3 is a perspective view illustrating a decorative panel according to the embodiment of the present invention as viewed from below.

As shown in FIG. 3, the decorative panel (27) is provided with one inlet (22) and four outlets (23, 23, . . . ). The inlet (22) is rectangular-shaped, and is formed in the center of the decorative panel (27). A suction grille member (29) provided with slits is fitted in the inlet (22). Each of the outlets (23) is in the shape of a narrow rectangle. The outlets (23) are formed along the sides of the decorative panel (27), respectively.

On a bottom surface of the decorative panel (27), a container housing part (20) for housing the dust container (43) is opened. An opening of the container housing part (20) is in the shape of a narrow rectangle. The container housing part (20) is formed between one side of the inlet (22) and the outlet (23) facing the side.

The indoor fan (39) is a so-called turbo fan. The indoor fan (39) is arranged near the center of the casing body (26) and above the inlet (22). The indoor fan (39) includes a fan motor (39*a*) and an impeller (39*b*). The fan motor (39*a*) is fixed to a top plate of the casing body (26). The impeller (39*b*) is connected to a rotation axis of the fan motor (39*a*). A bell mouth (25) communicating with the inlet (22) is provided below the indoor fan (39). The indoor fan (39) is configured to blow air sucked from below through the bell mouth (25) in a radial direction.

The indoor heat exchanger (37) is configured as a cross-fin type fin-and-tube heat exchanger. When viewed in plan, the indoor heat exchanger (37) is in the shape of a rectangular frame, and is arranged to surround the indoor fan (39). In the indoor heat exchanger (37), indoor air sent by the indoor fan (39) and a circulating refrigerant exchange heat.

The drain pan (40) is arranged below the indoor heat exchanger (37). The drain pan (40) receives drainage generated as a result of condensation of moisture in the air in the indoor heat exchanger (37). The drain pan (40) is provided with a drain pump (not shown) for discharging the drainage. The drain pan (40) is inclined so that the drainage is collected to part of the drain pan at which the drain pump is provided.

Figure 4:
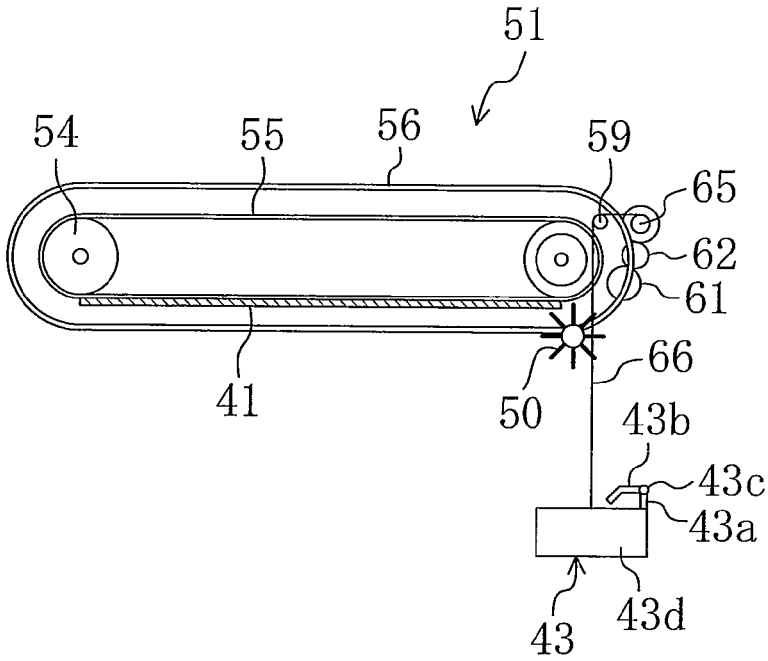
FIG. 4 is a side view illustrating a dust container and a dust removing mechanism according to the embodiment of the present invention.

The dust container (43) is a member in the shape of a narrow container. In the dust container (43), as shown in FIG. 4, one of longitudinal side surfaces (43*a*) extending in the longitudinal direction is taller than the other. To a top end of the taller longitudinal side surface (43*a*), a proximal end of a top surface portion (43*b*) which is bent downward at a distal end thereof is attached with a shaft (43*c*) interposed therebetween. The top surface portion (43*b*) is rotatable about the shaft (43*c*).

A top end of the shorter longitudinal side surface (43*a*) and the distal end of the top surface portion (43*b*) form an opening therebetween. For example, in removing the dust accumulated in the dust container (43), the opening can be enlarged by rotating the top surface portion (43*b*) about the shaft (43*c*). Hanging parts (not shown) for hanging wires (66) to be described later thereon are provided on top ends of lateral side surfaces (43*d*) extending in the lateral direction, respectively.

The dust container (43) can be lifted/lowered relative to the casing (34) by a container lifting/lowering mechanism (44) and a drive mechanism (57) to be described later. When the dust container (43) is positioned in the casing (34), the dust container (43) is housed in the container housing part (20). In this state, a bottom surface of the dust container (43) is exposed in the room.

The dust removing mechanism (42) is configured to remove dust trapped on the suction filter (41) from the suction filter (41). The dust removing mechanism (42) includes a rotating brush (50) as a brush member, and a filter holding mechanism (51). The rotating brush (50) includes a rod-like shaft, and a plurality of bristles attached to the circumference of the shaft. The rotating brush (50) is arranged in the top opening of the dust container (43) when the dust container (43) is positioned in the casing (34). An axial direction of the shaft of the rotating brush (50) corresponds with the longitudinal direction of the dust container (43).

Figure 5:
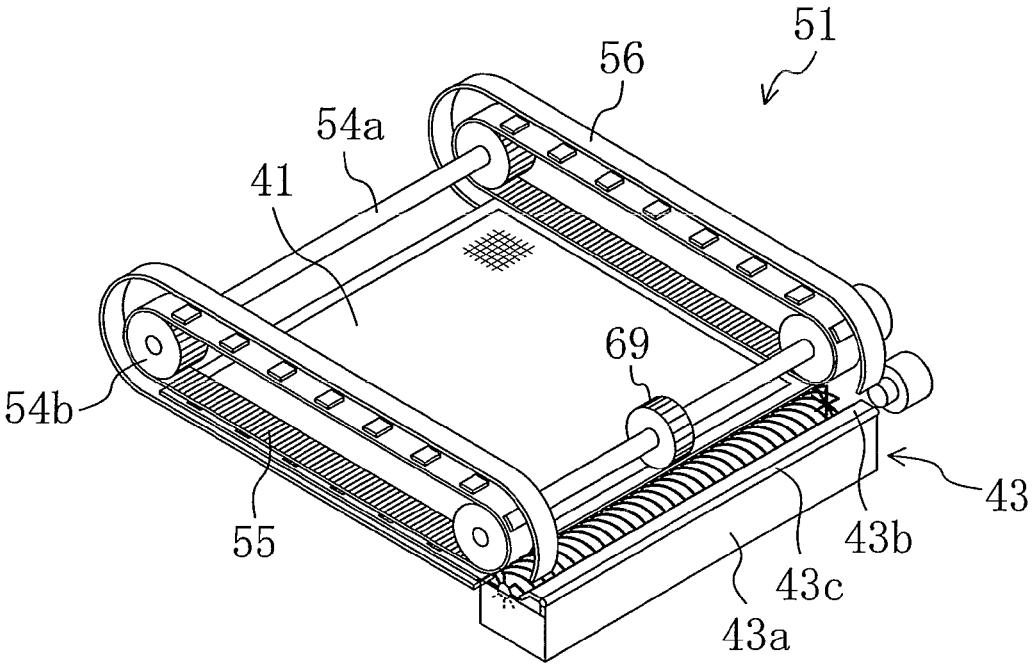
FIG. 5 is a perspective view illustrating a filter holding part according to the embodiment of the present invention as viewed from above.

The filter holding mechanism (51) is configured to hold the suction filter (41) in a movable manner. The filter holding mechanism (51) includes, as shown in FIG. 5, two pulleys (54), two drive belts (55), and two rail members (56). Each of the pulleys (54) includes a shaft (54*a*) and rollers (54*b*). The rollers (54*b*) are column-shaped, and attached to the ends of the shaft (54*a*), respectively. A plurality of grooves are formed on an outer circumferential surface of each of the rollers (54*b*) so that they can engage with cogs on the drive belt (55). The two pulleys (54) are arranged at an interval from each other so that the axial direction of their shafts (54*a*) coincides with the axial direction of the shaft of the rotating brush (50). One of the two pulleys (54) is positioned above the rotating brush (50).

Figure 6:
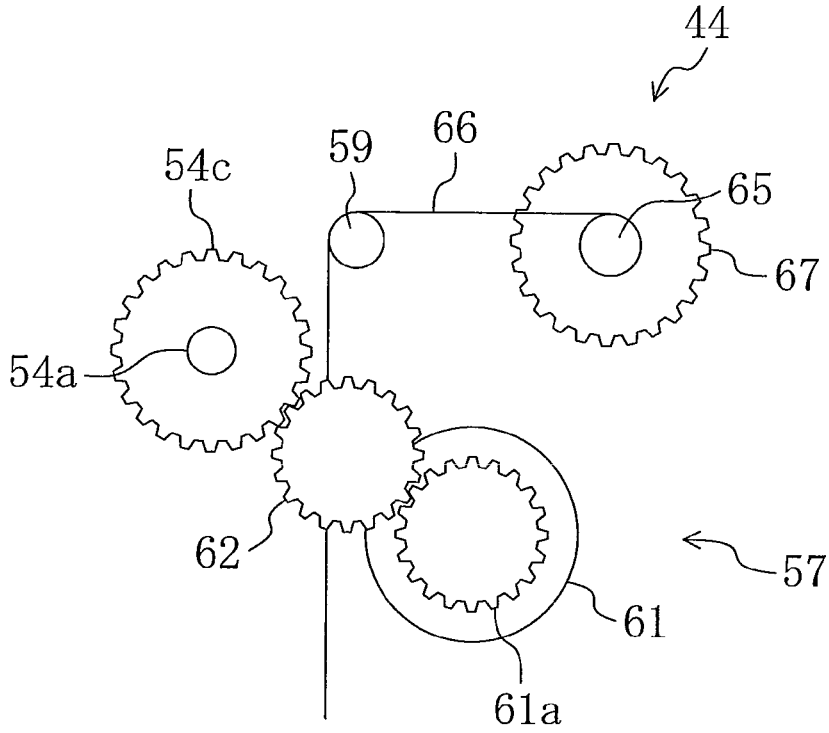
FIGS. 6A and 6B are side views illustrating a drive mechanism according to the embodiment of the present invention.
Figure 6:
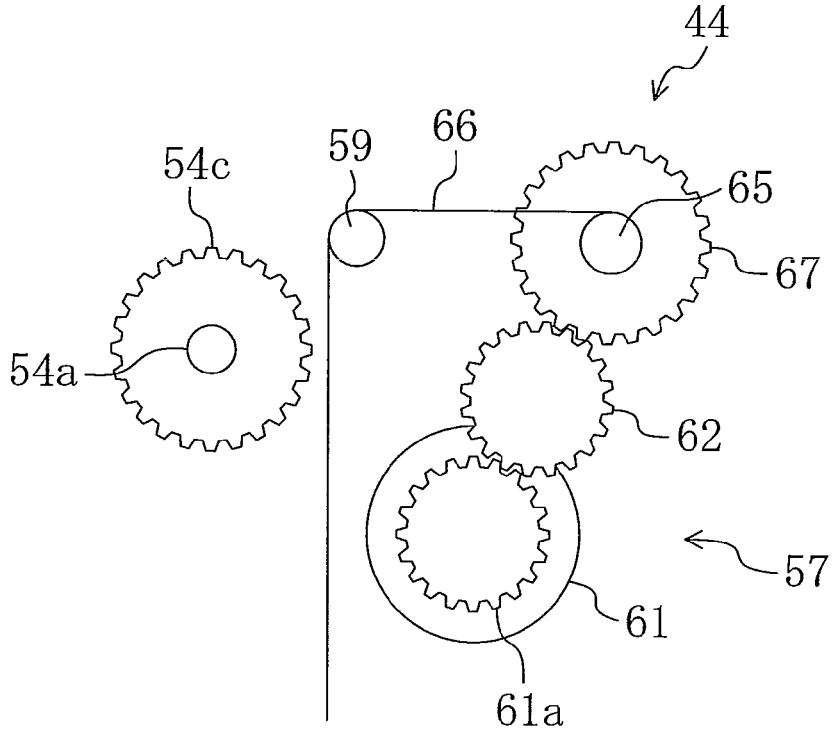

The pulley (54) above the rotating brush (50) is provided with a removing gear (69) as shown in FIGS. 6A and 6B. The removing gear (69) is attached to the center of the shaft (54*a*). The removing gear (69) rotates together with the shaft (54*a*). The removing gear (69) is formed to engage with a switching gear (62) to be described later.

Each of the drive belts (55) is a cogged belt provided with a plurality of cogs formed on an inner circumferential surface thereof. Each of the drive belts (55) is attached to the rollers (54*b*) on the same side of the pulleys (54) so that the cogs engage with the grooves on the rollers (54*b*). Attachment parts are formed on outer circumferential surfaces of the drive belts (55) so that a frame of the suction filter (41) is attached thereto. The suction filter (41) is attached to the drive belts (55) by engaging attachment parts on the frame of the suction filter (41) with the attachment parts of the drive belts (55). The rail members (56) are arranged to surround the drive belts (55), respectively. The drive belts (55) may be integral with the suction filter (41).

The container lifting/lowering mechanism (44) is configured to lift or lower the dust container (43) relative to the casing (34). The container lifting/lowering mechanism (44) includes a shaft (65), two wires (66), and a lifting/lowering gear (67). One end of each of the wires (66) is connected to an end of the shaft (65), respectively. The other ends of the wires (66) are connected to the hanging parts on the lateral side surfaces (43*d*) of the dust container (43), respectively. The wires (66) are hooked on a guide member (59) provided above the dust container (43). A single wire may be used as the wire (66). The wires (66) may be split in two or more at the other ends. Each of the other ends of the wires (66) is connected to the dust container (43).

The lifting/lowering gear (67) is attached to the center of the shaft (65). The lifting/lowering gear (67) rotates together with the shaft (65). The lifting/lowering gear (67) is formed to engage with a switching gear (62) to be described later.

The drive mechanism (57) includes, as shown in FIGS. 6A and 6B, a drive motor (61), a switching gear (62), and a switching motor (63). The drive motor (61) has a motor gear (61*a*) which rotates together with a shaft thereof. The motor gear (61*a*) is formed to engage with the switching gear (62). The switching gear (62) is supported by a gear support member so that it can move between a first position (FIG. 6(A)) in which the switching gear (62) engages with both the motor gear (61*a*) and the removing gear (69), and a second position (FIG. 6(B)) in which the switching gear (62) engages with both the motor gear (61*a*) and the lifting/lowering gear (67). The switching motor (63) is a motor for moving the switching gear (62) between the first and second positions.

The drive mechanism (57) can alternatively perform removal operation and lifting/lowering operation by the switching of the switching motor (63). The removal operation and the lifting/lowering operation will be described below.

Before performing the removal operation, every part of the suction filter (41) is positioned below the pulleys (54). The suction filter (41) is in this position during the heating and cooling operations. The suction filter (41) traps dust contained in the air that passes through the suction filter (41) during the cooling or heating operation. The removal operation is performed, for example, when total operating time of the air conditioner (10) from the previous removal operation reaches a predetermined length.

In the removal operation, the switching motor (63) moves the switching gear (62) to the first position, so that the switching gear (62) engages with both the motor gear (61*a*) and the removing gear (69). When the drive motor (61) is driven, power of the drive motor (61) is transmitted to the removing gear (69) through the motor gear (61*a*) and the switching gear (62). Then, when the removing gear (69) rotates and the pulleys (54) rotate, the suction filter (41) held on the drive belts (55) moves. As the suction filter (41) moves, the dust adhered to the suction filter (41) is removed by the bristles of the rotating brush (50). The dust removed from the suction filter (41) falls and accumulates in the dust container (43).

The rotating brush (50) rotates as it is pushed by the suction filter (41). The dust adhered to the rotating brush (50) is removed as the tips of the bristles of the rotating brush (50) strike the distal end of the top surface portion (43*b*) of the dust container (43). The dust removed from the rotating brush (50) falls and accumulates in the dust container (43).

In the removal operation, the drive motor (61) keeps driving after every part of the suction filter (41) passes above the rotating brush (50). Then, when the suction filter (41) returns to the position below the pulleys (54), the drive motor (61) stops.

Next, the lifting/lowering operation will be described. The indoor unit (13) of the present embodiment is provided with a detection sensor for detecting the amount of the dust in the dust container (43). For example, the detection sensor detects the amount of the dust in the dust container (43) by measuring the weight of the dust container (43). The air conditioner (10) is configured to display, for example, on a remote controller, that the dust container (43) requires cleaning, when the value detected by the detection sensor reaches or exceeds a predetermined value. Further, the air conditioner (10) is configured so that the lifting/lowering of the duct container (43) can be commanded using a remote controller. When a user commands the lowering of the dust container (43), the lifting/lowering operation is performed.

In the lifting/lowering operation, the switching motor (63) moves the switching gear (62) to the second position, so that the switching gear (62) engages with both the motor gear (61*a*) and the lifting/lowering gear (67). When the drive motor (61) is driven, power of the drive motor (61) is transmitted to the lifting/lowering gear (67) through the motor gear (61*a*) and the switching gear (62). Then, when the lifting/lowering gear (67) rotates, and the shaft (65) of the container lifting/lowering mechanism (44) rotates, the wires (66) are unwound to lower the dust container (43). Then, when the user commands the lifting of the dust container (43) using the remote controller after the dust in the dust container (43) is removed, the drive motor (61) rotates in a reverse direction of the direction of the lowering operation. The power of the drive motor (61) is then transmitted to the lifting/lowering gear (67) through the motor gear (61*a*) and the switching gear (62), and the wires (66) are wound to lift the dust container (43). The drive motor (61) stops when the dust container (43) is fitted in the container housing part (20).

Effect of the Embodiment

According to the present embodiment, the dust container (43) is lifted/lowered by driving the container lifting/lowering mechanism (44) by the drive motor (61). Therefore, in removing the dust accumulated in the dust container (43), work at high elevations is no longer necessary. This facilitates the removal of the dust from the dust container (43).

According to the present embodiment, the drive mechanism (57) functions as both a means for driving the dust removing mechanism (42) and a means for lifting/lowering the dust container (43). That is, there is no need of providing the means for driving the dust removing mechanism (42) and the means for lifting/lowering the dust container (43) separately. This provides a simple structure that allows for the lifting/lowering of the dust container (43) relative to the casing (34).

Modified Example of the Embodiment

A modified example of the embodiment will be described below. In this modified example, the removing gear (69) is not attached to the pulley (54), but is attached to the rotating brush (50). The removing gear (69) is attached to the center of the shaft of the rotating brush (50).

In the removal operation in this modified example, the switching gear (62) in the first position engages with both the motor gear (61*a*) and the removing gear (69). When the drive motor (61) is driven in this state, the rotating brush (50) rotates. Then, the suction filter (41) moves as it is pushed by the rotating brush (50), and the dust is removed from the suction filter (41).

Other Embodiments

The above-described embodiment may be modified as described below.

First Modified Example

Figure 7:
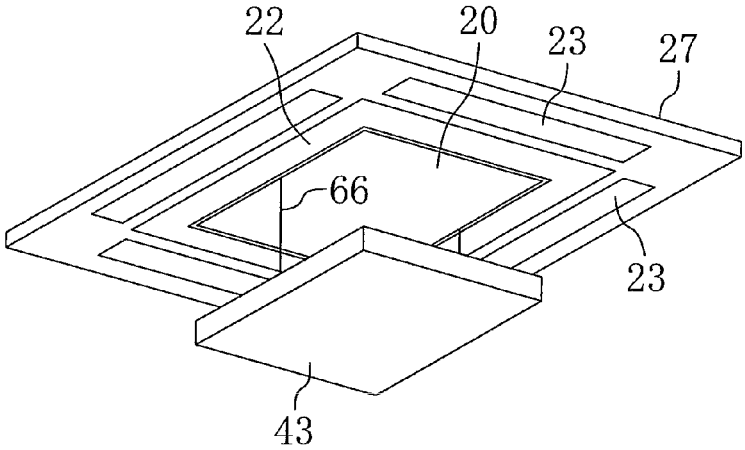
FIG. 7 is a perspective view illustrating a decorative panel according to a first modified example of the other embodiment as viewed from below.

The dust container (43) of the above-described embodiment may be flat-shaped as shown in FIG. 7. The dust container (43) is rectangular-shaped when viewed in plan. The rotating brush (50) is arranged near a top opening of the dust container (43).

The decorative panel (27) includes a container housing part (20) for housing the dust container (43) formed at the center thereof. In this decorative panel (27), an inlet (22) surrounding the dust container (43) is provided.

Second Modified Example

Figure 8:
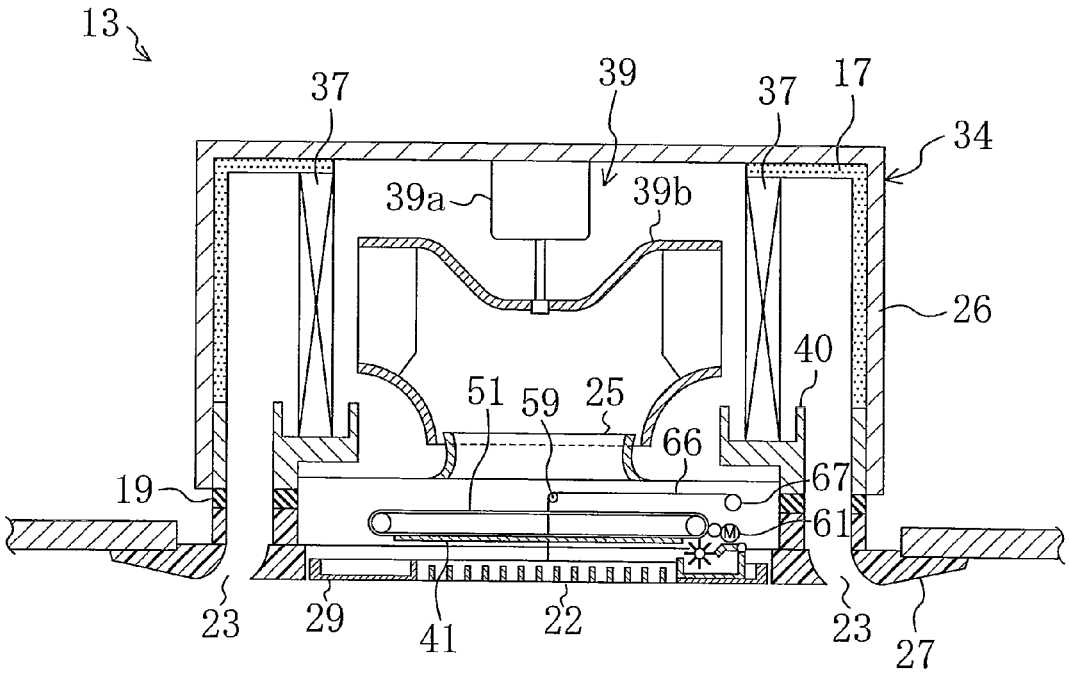
FIG. 8 is a cross-sectional view illustrating an indoor unit according to a second modified example of the other embodiment.
Figure 9:
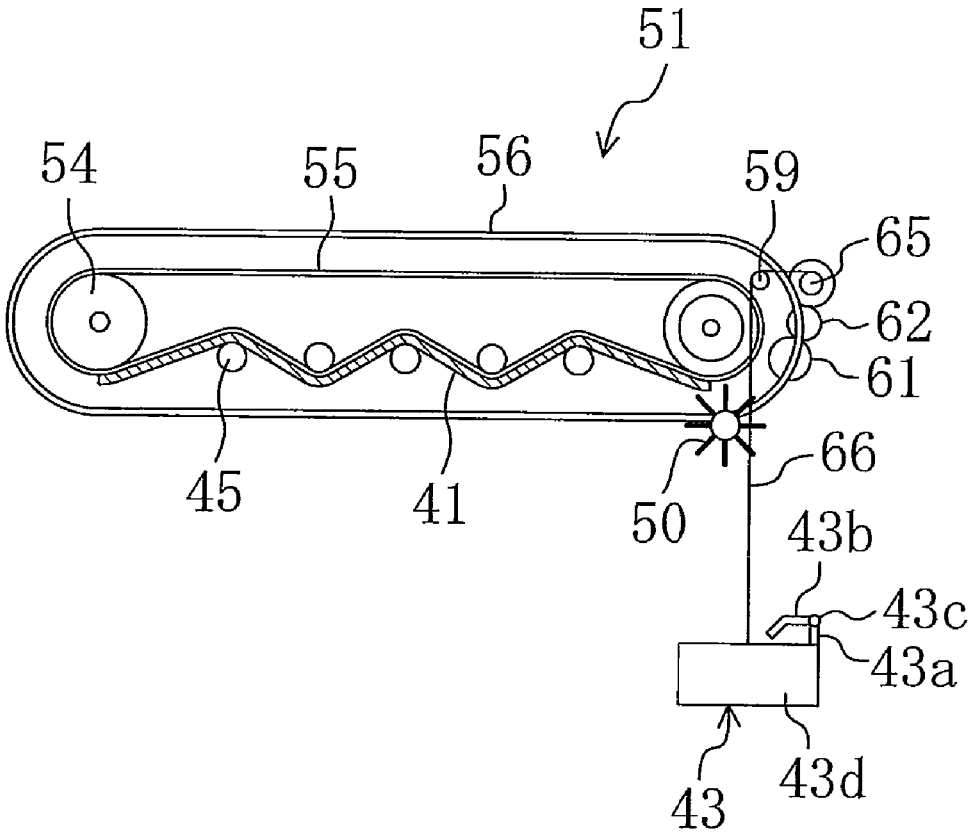
FIG. 9 is a side view illustrating a filter holding part according to a third modified example of the other embodiment.

The container lifting/lowering mechanism (44) of the above-described embodiment may be configured to lift/lower the dust container (43) together with the suction grille member (29) and the suction filter (41). As shown in FIG. 8, the dust container (43) is fixed to a top surface of the suction grille member (29). The wires (66) of the container lifting/lowering mechanism (44) are connected to the suction grille member (29).

Third Modified Example

In the above-described embodiment, a plurality of guide rollers (45) may be provided between the pulleys (54) so that the suction filter (41) is supported in the corrugated shape by the guide rollers (45) during the heating and cooling operations. In this case, an area of the suction filter (41) can be increased as compared with that of the suction filter (41) of the above-described embodiment supported in the flat plate shape. Therefore, suppose that the same amount of the dust is trapped thereon, the amount of the adhered dust per unit area is reduced as compared with the suction filter of the above-described embodiment. This reduces air resistance of the suction filter (41).

Fourth Modified Example

The filter holding mechanism (51) of the above-described embodiment may be configured to allow the suction filter (41) to make reciprocating movement instead of rotating movement.

Fifth Modified Example

The dust removing mechanism (42) of the above-described embodiment may include, instead of the rotating brush (50), a suction mechanism which sucks the dust on the suction filter (41) to remove the dust from the suction filter (41).

Sixth Modified Example

The indoor unit (13) of the above-described embodiment may be an indoor unit having the inlet (22) formed in a top plate or a side wall of the casing (34).

The embodiments described above are essentially preferable examples of the present invention, and they do not limit the present invention, an object to which the present invention is applied and use of the invention.

INDUSTRIAL APPLICABILITY

As described above, the present invention is useful for an indoor unit of an air conditioner installed on a ceiling.

The invention claimed is:

1. An indoor unit of an air conditioner installed on a ceiling, comprising:

a casing provided with an inlet and an outlet, the indoor unit controlling temperature of air sucked therein through the inlet, and blowing the air into a room through the outlet;

a filter member for trapping dust contained in the air sucked through the inlet;

a dust removing mechanism for removing the dust trapped on the filter member from the filter member;

a dust container for containing the dust removed from the filter member by the dust removing mechanism;

a container lifting/lowering mechanism for lifting/lowering the dust container relative to the casing; and a drive means having a single drive motor, and being capable of alternatively performing removal operation of removing the dust from the filter member by driving the dust removing mechanism by the drive motor, and lifting/lowering operation of lifting/lowering the dust container by driving the container lifting/lowering mechanism by the drive motor.

2. The indoor unit of the air conditioner of claim 1, wherein the dust removing mechanism includes a brush member which is in contact with the filter member, and a filter holding mechanism for holding the filter member in a movable manner, and the drive means engages with the filter holding mechanism in the removal operation to drive the filter holding mechanism, so as to move the filter member.

3. The indoor unit of an air conditioner of claim 1, wherein the drive means further comprises:

a switching gear movable between a first position and a second position, the switching gear engaging the dust removal mechanism when in the first position, and engaging the lifting/lowering mechanisms when in the second position.

4. The indoor unit of an air conditioner of claim 3, wherein the drive motor drives the dust removal mechanism when the switching gear is in the first position, and the drive motor drives the lifting/lowering mechanism when the switching gear is in the second position.

5. The indoor unit of an air conditioner of claim 3, wherein the drive means further comprises:

a motor gear attached to the drive motor, the motor gear engaging the switching gear in the first position and in the second position.

6. The indoor unit of an air conditioner of claim 1, further comprising:

a sensor configured to detect the amount of dust in the dust container.

7. The indoor unit of an air conditioner or claim 1, wherein the lifting/lowering mechanism further comprises:

a shaft;

a wire spooled around the shaft; and a gear connected to the shaft and configured to rotate the shaft.

8. The indoor unit of an air conditioner of claim 7, wherein the drive means further comprises:

a switching gear movable between a first position and a second position, the switching gear engaging the dust removal mechanism when in the first position, and engaging the gear connected to the shaft of the lifting/lowering mechanisms when in the second position.

9. The indoor unit of an air conditioner of claim 8, wherein the drive motor drives the dust removal mechanism when the switching gear is in the first position, and the drive motor drives the gear connected to the shaft of the lifting/lowering mechanism when the switching gear is in the second position.

10. The indoor unit of an air conditioner of claim 8, wherein the drive means further comprises:

a motor gear attached to the drive motor, the motor gear turning the switching gear and the switching gear turning the gear connected to the shaft of the lifting/lowering mechanism when the switching gear is in the second position.

* * * * *